US011215173B2

(12) United States Patent
Teshima et al.

(10) Patent No.: US 11,215,173 B2
(45) Date of Patent: Jan. 4, 2022

(54) DIAPHRAGM PUMP

(71) Applicant: NIPPON PILLAR PACKING CO., LTD., Osaka (JP)

(72) Inventors: Kazukiyo Teshima, Osaka (JP); Naoto Yamada, Osaka (JP); Motoaki Naruo, Osaka (JP)

(73) Assignee: NIPPON PILLAR PACKING CO., LTD., Osaka (JP)

( * ) Notice: Subject to any disclaimer, the term of this patent is extended or adjusted under 35 U.S.C. 154(b) by 224 days.

(21) Appl. No.: 16/308,685

(22) PCT Filed: Jun. 15, 2017

(86) PCT No.: PCT/JP2017/022138
§ 371 (c)(1),
(2) Date: Dec. 10, 2018

(87) PCT Pub. No.: WO2018/012188
PCT Pub. Date: Jan. 18, 2018

(65) Prior Publication Data

US 2019/0249659 A1 Aug. 15, 2019

(30) Foreign Application Priority Data

Jul. 12, 2016 (JP) ..... JP2016-137260

(51) Int. Cl.
*F04B 43/02* (2006.01)
*F04B 43/00* (2006.01)
(Continued)

(52) U.S. Cl.
CPC ..... *F04B 43/02* (2013.01); *F04B 13/00* (2013.01); *F04B 43/0081* (2013.01);
(Continued)

(58) Field of Classification Search
CPC ..... F04B 13/00; F04B 43/02; F04B 43/0081; F04B 49/06; F04B 49/065; F04B 49/02;
(Continued)

(56) References Cited

U.S. PATENT DOCUMENTS 4,883,409 A * 11/1989 Strohmeier ..... F04B 11/00 417/43
6,277,257 B1 * 8/2001 Paul ..... F04B 19/006 204/450
6,297,505 B1 * 10/2001 Frandsen ..... G01N 21/05 250/339.12
6,419,462 B1 * 7/2002 Horie ..... F04B 13/00 417/394
(Continued)

FOREIGN PATENT DOCUMENTS

JP 2007-23935 A 2/2007
JP 2008-545464 A 12/2008
JP 2016-61169 A 4/2016

OTHER PUBLICATIONS

International Search Report dated Aug. 15, 2017 in PCT/JP2017/022138 filed Jun. 15, 2017.

*Primary Examiner* — Charles G Freay
(74) *Attorney, Agent, or Firm* — Oblon, McClelland, Maier & Neustadt, L.L.P.

(57) ABSTRACT

A diaphragm pump includes: a housing; a diaphragm; an actuator configured to reciprocate the diaphragm based on a previously selected operation mode out of a plurality of operation modes; a setting device configured to set and send an operation mode and operating conditions; and a control device configured to receive the operation mode and the operating conditions from the setting device, and control the actuator to move the diaphragm forward or backward in accordance with the operation mode and the operating conditions received from the setting device. The plurality of operation modes include a normal operation mode in which the actuator is driven to perform a series of a suction process to suck a fluid and a discharge process to discharge the
(Continued)

sucked fluid, and a partial operation mode in which the actuator is driven to perform the series of processes partially.

1 Claim, 3 Drawing Sheets

(51) Int. Cl.
*F04B 13/00* (2006.01)
*F04B 49/06* (2006.01)
*F04B 49/02* (2006.01)

(52) U.S. Cl.
CPC ..... *F04B 49/02* (2013.01); *F04B 49/065* (2013.01); *F04B 2205/503* (2013.01); *F05B 2210/11* (2013.01)

(58) Field of Classification Search
CPC . F04B 49/03; F04B 2201/11; F04B 2205/503
See application file for complete search history.

(56) References Cited

U.S. PATENT DOCUMENTS 6,739,478 B2 * 5/2004 Bach ..... B01L 3/0206 222/1
7,189,320 B2 * 3/2007 Takao ..... F04B 9/02 210/101
7,686,595 B1 * 3/2010 Graham ..... F04B 13/00 417/413.1
8,292,598 B2 * 10/2012 Laverdiere ..... F04B 43/02 417/274
8,430,833 B2 * 4/2013 Gagel ..... F04B 13/00 604/6.11
2005/0180856 A1 * 8/2005 Bach ..... F04B 43/12 417/42
2009/0043239 A1 * 2/2009 Gagel ..... A61M 1/1656 604/6.11
2012/0163998 A1 * 6/2012 Takahashi ..... F04B 49/00 417/44.1
2016/0139092 A1 * 5/2016 Dumas ..... F04B 53/14 417/53
2019/0162210 A1 * 5/2019 Starkey ..... F04B 49/06

* cited by examiner

DIAPHRAGM PUMP

TECHNICAL FIELD

The present invention relates to a diaphragm pump.

BACKGROUND ART

A diaphragm pump for transferring fluid such as medical fluid is known (e.g., see Patent Document 1). Such a diaphragm pump is often used for manufacturing semiconductors, liquid crystals, organic electroluminescence (EL) devices, solar cells, or light emitting diodes (LED). The diaphragm pump is provided with a diaphragm, an actuator, and a control device.

In the diaphragm pump, the diaphragm is disposed to form a pump chamber in a housing, and is reciprocable to change the volume of the pump chamber so that fluid can be sucked into the pump chamber and discharged from the pump chamber.

The actuator is configured to reciprocate the diaphragm. The control device is configured to control the actuator to move the diaphragm forward or backward in accordance with previously set operation conditions (conditions relating to a continuous series of a suction process and a discharge process).

When the diaphragm pump is operated to transfer fluid, the diaphragm pump reciprocates the diaphragm by using the actuator and the control device to alternately repeat a suction process for sucking fluid and a discharge process for discharging the fluid.

PRIOR ART DOCUMENT

Patent Document

Patent document 1: Japanese Unexamined Patent Application Publication No. 2007-023935 A

SUMMARY OF THE INVENTION

In a conventional diaphragm pump working under the operating conditions inappropriate to a kind of the fluid, more particularly, if the rate of suction of the fluid is set to be higher than an appropriate rate, air bubbles (micro bubbles) can be mixed in the fluid discharged from the diaphragm pump.

Such mixing of air bubbles in the fluid is an improper action, which indicates inappropriateness of the operating conditions of the diaphragm pump. To find operating conditions appropriate to the kind of the fluid needs operations including suction processes and discharge processes under various operating conditions and check whether air bubbles are mixed in the fluid.

However, when such check is conducted, the diaphragm pump treats a suction process and a discharge process as a single set of processes. This single set of processes are performed every time the operating conditions change. As a result, there is no choice but to transfer a relatively large amount of fluid to find operating conditions appropriate to the kind of the fluid.

The diaphragm pump tends to transfer a larger amount of useless fluid, which is used only for optimization of operating conditions of the diaphragm pump but cannot be used for an actual purpose. This may increase the cost for operating the diaphragm pump. In particular, when the fluid is high-costed, increase in cost easily become prominent.

The present invention was made in view of such circumstances. An object of the present invention is to provide a diaphragm pump capable of selecting appropriate operating conditions at a low cost.

According to an aspect of the present invention, a diaphragm pump includes: a housing; a diaphragm disposed in the housing to form a pump chamber, and reciprocable to change the volume of the pump chamber to suck fluid into the pump chamber and discharge the fluid from the pump chamber; an actuator configured to reciprocate the diaphragm based on an operation mode previously selected out of a plurality of operation modes; a setting device having an input section capable of receiving entry of an operation mode and operating conditions corresponding to the operation mode, configured to set and send the operation mode and the operating conditions; and a control device configured to receive the operation mode and the operating conditions sent from the setting device, and control the actuator to move the diaphragm forward or backward in accordance with the operation mode and the operating conditions received from the setting device. The plurality of operation modes include: a normal operation mode in which the actuator is driven to perform a series of a suction process to suck the fluid and a discharge process to discharge the sucked fluid; and a partial operation mode in which the actuator is driven to perform the series of processes partially.

With this configuration, selection of the partial operation mode makes it possible to find operating conditions appropriate to the kind of the fluid to operate the diaphragm pump under the appropriate operating conditions in the normal operation mode. Further, the diaphragm pump in the partial operation mode can separately perform the suction process and the discharge process. At that time, the diaphragm pump can perform the suction or discharge process separately under operating conditions different between the suction process and the discharge process. Therefore, the diaphragm pump can be operated under various operating conditions with a tiny amount of fluid per suction or discharge process. This can save the fluid amount used to find the appropriate operating conditions. Thus, the diaphragm pump enables the appropriate operating conditions to be found at a low cost.

According to another embodiment of the present invention, when the partial operation mode is selected out of the plurality of operation modes, in response to each instruction that the setting device sends to the control device, the actuator performs a single process to suck or discharge a first predetermined amount of fluid.

According to the present invention, it is possible to provide a diaphragm pump capable of selecting appropriate operating conditions at a low cost.

DESCRIPTION OF THE EMBODIMENTS

An embodiment of a diaphragm pump 1 according to the present invention will now be described with reference to the drawings.

Figure 1:
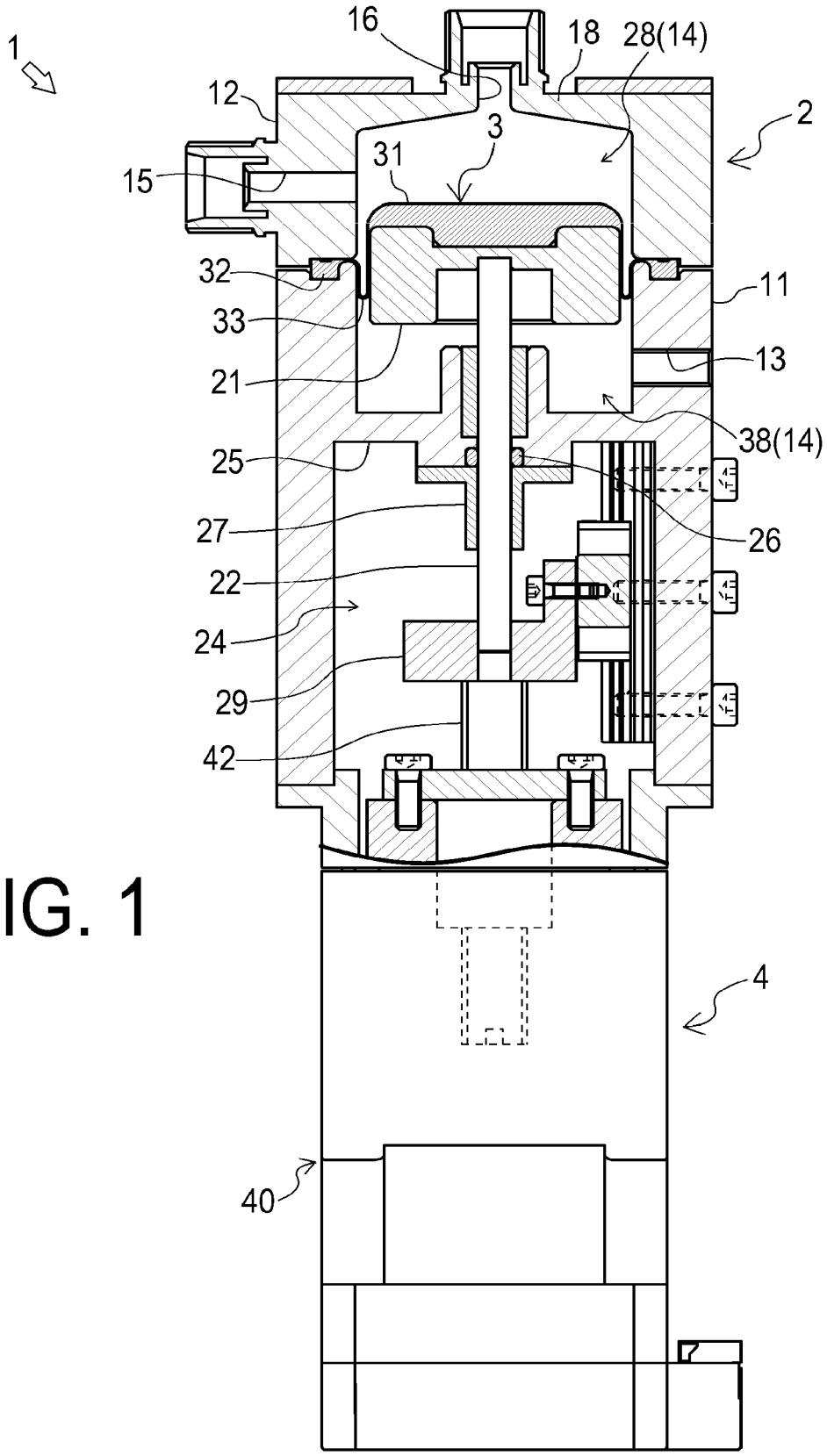
FIG. 1 is a side sectional view of a diaphragm pump according to an embodiment of the present invention, showing the diaphragm pump after completion of a discharge process.
Figure 2:
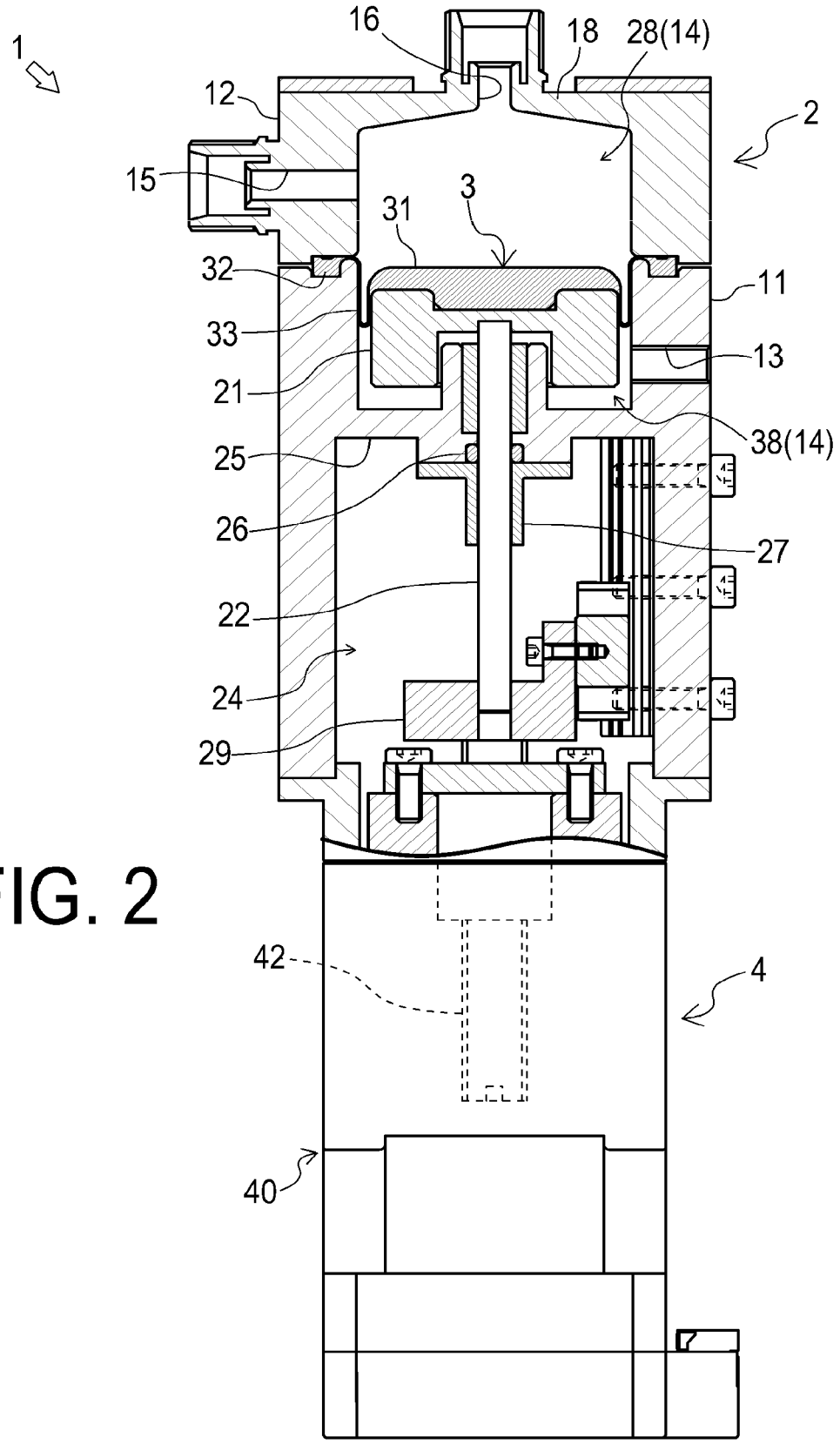
FIG. 2 is a side sectional view showing the diaphragm pump of FIG. 1 after completion of a suction process.

The diaphragm pump 1 is a volumetric reciprocating pump for transferring fluid such as chemical liquid. As shown in FIGS. 1 and 2, the diaphragm pump 1 includes a housing 2, a diaphragm 3, an actuator 4, a setting device 7, and a control device 8.

In the following description, a back-and-forth direction means the vertical direction on the drawings. Forward movement is referred to as "advance," and backward movement is as "retreat."

In the present embodiment, the housing 2 includes a cylinder 11 and a pump head 12. The cylinder 11 is made of stainless steel such as SUS 304. The cylinder 11 has a circular-cylindrical shape and is disposed such that its axial direction is the back-and-forth direction.

The cylinder 11 has a vent hole 13. The vent hole 13 is provided in a side portion of the cylinder 11 to penetrate in a direction intersecting with the axial direction of the cylinder 11. The vent hole 13 can be connected to a decompressor (not shown) such as a vacuum pump or an aspirator.

The pump head 12 is made of, for example, a fluororesin such as polytetrafluoroethylene (PTFE). The pump head 12 has a covered-cylindrical shape with substantially the same inner diameter as the cylinder 11, and is disposed coaxially with the cylinder 11.

The pump head 12 is attached to one axial end (front end) of the cylinder 11 to close an opening on one axial side (front side) of the cylinder 11. As a result, a first internal space 14 surrounded by the cylinder 11 and the pump head 12 is formed in the housing 2.

The pump head 12 has a suction port 15 and a discharge port 16. The suction port 15 is provided in a side portion of the pump head 12 to penetrate in a direction intersecting with the axial direction of the pump head 12. The suction port 15 may be connected to predetermined equipment (not shown) serving as a fluid supply source via an on-off valve on the suction side, piping, and the like.

The discharge port 16 is provided in the one axial end (front end) of the pump head 12, namely, a lid portion 18, to penetrate in the axial direction of the pump head 12. The discharge port 16 is disposed at a radially-center part of the lid portion 18, and may be connected to predetermined equipment (not shown) serving as a fluid supply source via an on-off valve on the discharge side, piping, and the like.

The actuator 4 is configured to reciprocate the diaphragm 3 based on an operation mode of the diaphragm pump 1 previously selected out of a plurality of operation modes. In the present embodiment, the actuator 4 includes a piston 21 and a shaft 22, which are movable members. The piston 21 and the shaft 22 are reciprocable in the housing 2.

The piston 21 is made of, for example, an aluminum alloy. The piston 21 has a cylindrical shape including a recess, and is disposed coaxially with the housing 2 (the cylinder 11). The piston 21 is accommodated in the first internal space 14 of the housing 2.

The piston 21 is provided to generate a clearance between the piston 21 and an inner wall of the housing 2 (the cylinder 11 and the pump head 12), and is reciprocable along the inner wall of the housing 2 in the axial direction of the housing 2 (the back-and-forth direction).

The shaft 22 is made of, for example, steel such as quenched high-carbon chromium bearing steel. The shaft 22 is disposed coaxially with the piston 21 and is axially-reciprocable to penetrate a partition 25 via an O-ring 26; the partition 25 divides the interior of the housing 2 into the first internal space 14 and a second internal space 24.

The O-ring 26 is held on the partition 25 by the O-ring retainer 27. The O-ring retainer 27 is a stationary member accommodated in the housing 2 and is made of, for example, stainless steel. The O-ring retainer 27 is disposed in the second internal space 24 of the housing 2 such that the shaft 22 penetrates without contact with the O-ring retainer 27.

The shaft 22 has one axial end (front end) located in the first internal space 14 and the other axial end (back end) located in the second internal space 24. The shaft 22 is connected to the piston 21 at the one axial end to be reciprocated integrally with the piston 21.

The actuator 4 also includes, as a movable member, a shaft holder 29 for holding the shaft 22 in the housing 2. The shaft holder 29 is made of, for example, stainless steel. The shaft holder 29 is disposed in the second internal space 24 of the housing 2, and is provided to couple the shaft 22 with an output shaft 42 described later.

The diaphragm 3 is disposed to form a pump chamber 28 in the housing 2, and is reciprocable with respect to an origin to change the volume of the pump chamber 28. The diaphragm 3 is a rolling diaphragm.

In the present embodiment, the diaphragm 3 is made of, for example, fluororesin such as PTFE. The diaphragm 3 has a center part having a covered cylindrical shape, and is provided to cover one axial side (front side) of the piston 21 with the center part.

The diaphragm 3 includes a central portion 31, an outer peripheral portion 32, and a folded portion 33. The central portion 31 constitutes a lid part of the diaphragm 3, which is attached to the piston 21 to face, across the pump chamber 28, one axial end (ceiling portion) of the housing 2, namely, the lid portion 18.

The outer peripheral portion 32 is an outer peripheral end of the diaphragm 3, which is located radially outside the central portion 31 and is sandwiched between the cylinder 11 and the pump head 12. The folded portion 33 has flexibility and is deformably provided between the central portion 31 and the outer peripheral portion 32.

The outer peripheral portion 32 fixes the diaphragm 3 on the housing 2 such that the diaphragm 3 can deform the folded portion 33 between the inner wall of the housing 2 and the piston 21, and change the axial position of the central portion 31, to be reciprocated integrally with the piston 21.

The diaphragm 3 also partitions the first internal space 14 of the housing 2 into the pump chamber 28 and a decompression chamber 38. The pump chamber 28 is surrounded by the diaphragm 3 (the central portion 31 and the folded portion 33) and the pump head 12.

Therefore, change in position of the diaphragm 3 caused by its integral reciprocation with the piston 21, namely, change in position of the central portion 31 accompanying deformation of the folded portion 33 enables change (increase or decrease) in volume of the pump chamber 28.

The pump chamber 28 is connected to both the suction port 15 and the discharge port 16, and can temporarily store fluid sucked from the suction port 15. The decompression chamber 38 is connected to the vent hole 13 and can be depressurized by the decompression device.

In the diaphragm pump 1, the actuator 4 also includes a motor 40 as a driving source. In the present embodiment, the actuator 4 further includes the output shaft 42 as a movable member, in addition to the piston 21, the shaft 22 and the motor 40.

The motor 40 is a pulse motor (stepping motor). The motor 40 is provided on another axial side (back side) of the housing 2. The output shaft 42 is a screw shaft (feed screw).

The output shaft 42 is connected to the rotation shaft of the motor 40 to be interlocked with it.

The output shaft 42 is axially reciprocable and projected from the motor 40 into the housing 2. The output shaft 42 is disposed coaxially with the shaft 22 and has one axial end (front end) connected to another axial end (back end) of the shaft 22 via the shaft holder 29.

The actuator 4 can convert the rotational motion of the motor 40 into a linear motion of the output shaft 42 and the shaft 22 so that the output shaft 42, the piston 21, and the like can reciprocate the diaphragm 3 in the axial (back-and-forth) direction.

Figure 3:
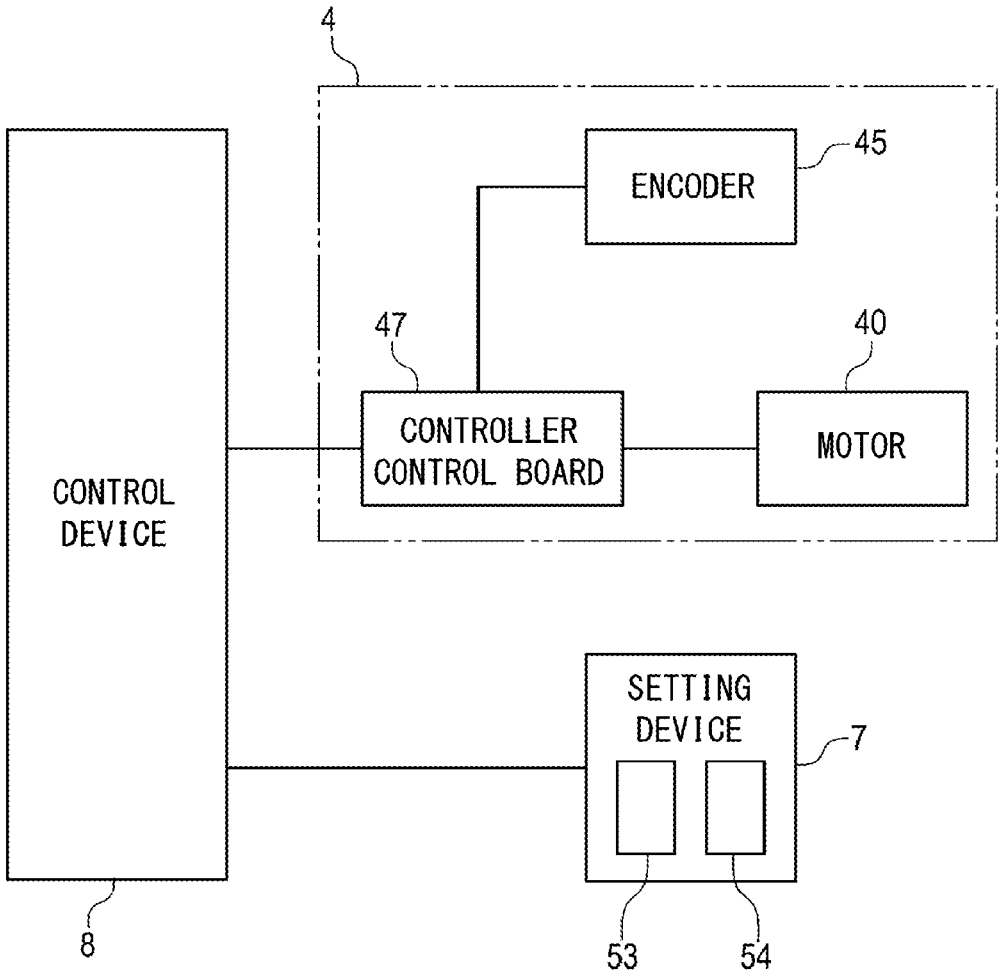
FIG. 3 is a block diagram of the diaphragm pump of FIG. 1

The actuator 4 uses an encoder 45 (see FIG. 3). The encoder 45 is attached to the rotation shaft of the motor 40. The encoder 45 is used for drive control of the motor 40, and is configured to output signal pulses synchronized with the rotation of the motor 40.

As shown in FIG. 3, the setting device 7 includes an input section 53, and is configured to set and send an operation mode and operating conditions of the diaphragm pump 1. The input section 53 can receive entry of an operation mode and operating conditions corresponding to the operation mode. In the present embodiment, the setting device 7 includes a display section 54 capable of displaying the operation mode and the operating conditions of the diaphragm pump 1.

Parameters for operating conditions corresponding to the selected operation mode, (e.g., parameters for suction (such as sucking rate), parameters for discharge (e.g., discharging rate) and parameters for the diaphragm 3 (e.g., moving amount)) are inputted to the setting device 7 via the input section 53. Based on the parameters, the setting device 7 sets the operating conditions of the diaphragm pump 1 and sends them to the control device 8.

The setting device 7 only has to set operating conditions of the diaphragm pump 1, and may be separated from the control device 8, or may be integral with the control device 8.

Further, the control device 8 is configured to receive the operation mode and the operating conditions of the diaphragm pump 1 sent from the setting device 7. The control device 8 is configured to control the actuator 4 to move the diaphragm 3 forward or backward in accordance with the operation mode and the operating conditions of the diaphragm pump 1 received from the setting device 7.

Note that the forward movement of the diaphragm 3 is the movement (advancing) thereof that decreases the volume of the pump chamber 28, and the backward movement thereof is the movement (retreating) thereof that increases the volume of the pump chamber 28.

In the present embodiment, as shown in FIG. 3, the control device 8 is electrically connected to the motor 40 via a controller (control board) 47, and in parallel, to the encoder 45. The control device 8 is configured to output a driving signal for the drive control of the motor 40 to the controller 47. The controller 47 is configured to output signal pulses for the drive of the motor 40 in accordance with the driving signal.

The controller 47 acquires signal pulses from the encoder 45 and detects the rotation amount (rotation angle) of the motor 40 according to the acquired signal pulses (pulse number) to output the detected rotation amount to the control device 8. According to the rotation amount acquired from the controller 47, the control device 8 can find the position of the diaphragm 3 in the reciprocation direction.

To make the diaphragm pump 1 alternately perform a suction process and a discharge process for fluid transfer during its operation, the control device 8 can perform the driving control of the motor 40 to reciprocate the diaphragm 3 in the axial direction of the housing 2.

When the diaphragm pump 1 performs a suction process, the motor 40 rotates in the negative direction to make the piston 21 move the diaphragm 3 backward to be displaced (from the position shown in FIG. 1 to the position shown in FIG. 2) to increase the volume of the pump chamber 28. At that time, the control device 8 also controls opening of an on-off valve on the suction side and closing of an on-off valve on the discharge side. As a result, fluid is sucked into the pump chamber 28 through the suction port 15.

When the diaphragm pump 1 performs a discharge process, the motor 40 rotates in the positive direction to make the piston 21 move the diaphragm 3 forward to be displaced (from the position shown in FIG. 2 to the position shown in FIG. 1) to decrease the volume of the pump chamber 28. At that time, the control device 8 also controls closing of the on-off valve on the suction side and opening of the on-off valve on the discharge side. As a result, the fluid is discharged from the pump chamber 28 through the discharge port 16.

The diaphragm pump 1 configured in such a manner has a plurality of operation modes as mentioned above. The plurality of operation modes include at least a normal operation mode and a partial operation mode; in the normal operation mode, the actuator 4 is driven to perform a series of a suction process for sucking a fluid and a discharge process for discharging the sucked fluid, (suction→discharge); in the partial operation mode, the actuator 4 is driven to perform the series of processes partially.

Although the partial operation mode is mainly used to select operation conditions of the diaphragm pump 1 in the normal operation mode, the partial operation mode may be used to check the state of the medical fluid to be transferred in the diaphragm pump 1 (e.g. whether foreign matter is mixed in the fluid or not).

The normal operation mode is typically selected when the fluid is transferred, in which the series of processes are continuously performed (automatic operation). The term "continuously" herein does not only mean that the diaphragm 3 continuously performs reciprocation without stop, but also means that the diaphragm 3 continuously performs reciprocation with an intermission (intermittently).

The partial operation mode is selected when the fluid is transferred for the first time, (e.g., at the initial use of the diaphragm pump 1, or after change of the kind of the fluid to be transferred,) or when the state of the fluid is checked. This means that the partial operation mode is the mode in which the series of processes are partially performed (manual operation).

In the present embodiment, a user can select an operation mode out of a plurality of operation modes with the setting device 7. After selecting the operation mode, the user inputs predetermined parameters for operating conditions to the setting device 7.

The setting device 7 automatically sets operating conditions according to the operation mode selected and the operating condition parameters inputted, and then, sends them to the control device 8. To meet the operation mode and the operating conditions, the setting device 7 sends instructions to the control device 8, and according to the instructions, the control device 8 drives the actuator 4 to move the diaphragm 3 forward or backward.

When the partial operation mode is selected out of the plurality of operation modes, the diaphragm pump 1 can perform a suction process to suck the fluid or a discharge process to discharge the fluid separately in response to instructions on the operating conditions, which the setting device 7 irregularly sends to the control device 8.

In this case, the diaphragm pump 1 may perform the suction process and the discharge process as separate processes. The diaphragm pump 1 need not to perform the suction process and the discharge process as a continuous series of processes. This eliminates the need for setting operating conditions appropriate to the continuous series of processes.

Further, when the partial operation mode is selected out of the plurality of operation modes, the diaphragm pump 1 in the present embodiment performs a single process to suck or discharge a first predetermined amount of the fluid in response to each instruction (operating conditions relating to the suction process or the discharge process) that the setting device 7 sends to the control device 8. The first predetermined amount can be freely set based on operating condition parameters that the user inputted to the setting device 7.

The user can freely input desired operating condition parameters to the setting device 7. The diaphragm pump 1 allows the user to select the sucking rate and the discharging rate within a wide range from a low rate to a high rate, and the to-be-transferred amount within a wide range from a very little amount to quite a large amount.

The user can instruct the execution of the suction process or the discharge process with the setting device 7. For example, the setting device 7 has a run button as an operation section to execute the suction process or the discharge process. The user can instruct the execution of the suction process or the discharge process by pressing down the run button. Each time the user instructs, an instruction is sent from the setting device 7 to the control device 8.

The user may select quite a large moving amount and instruct a single execution of the suction or discharge process, or alternatively select a very small moving amount and instruct repeated executions of the suction or discharge process by continuously pressing down the run button.

As mentioned above, the diaphragm pump 1 can, under different operating conditions, perform the suction process and the discharge process. After the partial operation mode is selected, the
diaphragm pump 1 enables freely-selected parameters for the suction process to be inputted as operating condition parameters, and
according to the parameters, can perform the suction process.

After the partial operation mode is selected, the diaphragm pump 1 enables freely-selected parameters for the discharge process to be inputted as operating condition parameters, and according to the parameters, can perform the discharge process. As a result, the diaphragm pump 1 can perform the suction process and the
discharge process, while adjusting operating conditions differently between the suction process and the discharge process.

In other words, by selecting the partial operation mode, a user can find operating conditions appropriate to the kind of the fluid so that the user can operate the diaphragm pump in the normal operation mode under appropriate operating conditions. The user enables the diaphragm pump 1 in the partial operation mode to perform the suction process and the discharge process separately.

At that time, the user changes operating conditions for each suction process and each discharge process. Accordingly, the
diaphragm pump 1 can treat the fluid under various operating conditions with a tiny amount of fluid per suction or discharge process. This can reduce fluid amount used to find appropriate operating conditions that prevent air bubbles (micro bubbles) from being mixed in the fluid. As a result, the appropriate operating conditions can be found at a low cost.

The diaphragm pump 1 in the present embodiment enables a user to determine whether the operating conditions of the diaphragm pump 1 are appropriate or not by checking whether there is air bubbles mixed in the discharged fluid. When a discharge pipe on the discharge side has a color that allows the inside of the pipe to be visible, (i.e., transparent or translucent,) the user can conduct the check by viewing the fluid discharged from the discharge port via the pipe on the discharge side.

As a result, when there is no air bubbles mixed in the discharged fluid, the user can judge that the operating conditions set at that point are appropriate. On the other hand, when there is air bubbles mixed in the discharged fluid, the user can judge that the operating conditions of the diaphragm pump 1 are inappropriate. When the fluid is viewed, the flow rate of the fluid can negatively affect the visibility of the fluid. In this case, the user only has to operate the setting device 7 to change operating conditions of suction or discharge rate, or to temporally stop operation of the diaphragm pump 1.

Further, when selecting the partial operation mode, the user can check the state of fluid such as medical fluid transferred by the diaphragm pump 1 (e.g., check whether there is foreign matters mixed in the fluid).

In the embodiment described above, the structural and functional configuration of the actuator 4, the setting device 7, and the control device 8 can appropriately be changed in accordance with the gist of the present invention. For example, the controller 47 may be built into the control device 8. In this case, the motor 40 and the encoder 45 are each directly connected to the control device 8. The control device 8 outputs signal pulses for driving the motor 40 to the motor 40, and in parallel, obtains the signal pulses from the encoder 45 and detects a rotation amount (rotation angle) of the motor 40 based on the obtained signal pulses. In addition, the motor 40 may be a motor other than a pulse motor (stepping motor).

The plurality of operation modes may include operation modes other than the normal operation mode and the partial operation mode. In addition, the normal operation mode and the partial operation mode may be divided into further detailed operation modes. Specifically, the partial operation mode may be divided into a partial operation mode at the time of moving forward (advance) and a partial operation mode at the time of moving backward (retreat).

DESCRIPTION OF REFERENCE NUMERALS

1: diaphragm pump; 2: housing 3: diaphragm; 4: actuator; 7: setting device; 8: control device; 53: input section.

What is claimed is:

1. A diaphragm pump comprising:

a housing;

a diaphragm disposed in the housing to form a pump chamber, and reciprocable to change a volume of the pump chamber to suck fluid into the pump chamber and discharge the sucked fluid from the pump chamber;

an actuator including a motor and a control board, the actuator configured to reciprocate the diaphragm based on an operation mode previously selected out of a plurality of operation modes;

a setting device having an input section configured to receive from a user entry of an operation mode and operating conditions corresponding to the operation mode, the setting device being configured to send the operation mode and the operating conditions that the input section has been received; and a control device connected to the setting device and connected to the motor via the control board, the control device configured to receive the operation mode and the operating conditions from the setting device, and control the motor of the actuator to move the diaphragm forward or backward by outputting a driving signal for drive control of the motor to the control board in accordance with the operation mode and the operating conditions received from the setting device, wherein the plurality of operation modes include:

a normal operation mode in which a suction process to suck the fluid into the pump chamber and a discharge process to discharge the sucked fluid from the pump chamber are continuously performed as a series of processes; and a partial operation mode in which the suction process to suck a first amount of fluid into the pump chamber at a suction rate is performed as a separate process each time when the setting device sends to the control device an instruction specifying the first amount of fluid and the suction rate as the operating conditions, and the discharge process to discharge a second amount of fluid from the pump chamber at a discharge rate is performed as a separate process each time when the setting device sends to the control device an instruction specifying the second amount of fluid and the discharge rate as the operating conditions.

* * * * *